United States Patent [19]

Lundman

[11] 4,421,300

[45] Dec. 20, 1983

[54] VEHICLE RAMP

[76] Inventor: Phillip L. Lundman, 419 Wheeler Ave., Fredonia, Wis. 53021

[21] Appl. No.: 360,629

[22] Filed: Mar. 22, 1982

[51] Int. Cl.[3] ..... E02C 3/00

[52] U.S. Cl. ..... 254/88; 248/352

[58] Field of Search ..... 254/88; 248/352

[56] References Cited

U.S. PATENT DOCUMENTS

| | | | |
|---|---|---|---|
| 1,548,189 | 8/1925 | Costello | 254/88 |
| 1,650,182 | 11/1927 | Brochu | 254/88 |
| 2,924,427 | 2/1960 | Larson | 254/88 |
| 3,178,156 | 4/1965 | Rigers | 254/88 |
| 3,638,910 | 2/1972 | Nellis et al. | 254/88 |
| 3,847,376 | 11/1974 | Binding | 254/88 |
| 3,863,895 | 2/1975 | Grewe et al. | 254/88 |
| 3,873,064 | 3/1975 | Lundman | 254/88 |
| 3,917,227 | 11/1975 | West | 254/88 |
| 4,050,403 | 9/1977 | Miller | 254/88 |

*Primary Examiner*—Frederick R. Schmidt

*Assistant Examiner*—Steven P. Schad

[57] ABSTRACT

A vehicle ramp is shown housing a platform having an upper surface adapted to support the wheel of a vehicle, a generally vertical leg having an upper end supporting the platform rearward portion and an inclined ramp adapted to support a forward portion of the platform and to permit a vehicle wheel to move up to the platform. The inclined ramp includes a longitudinal axis and having opposite sides, a lower end adapted to engage the ground, and including a blade for engaging the supporting surface as a vehicle wheel engages the lower end of the inclined ramp and applies a downward force on the lower end and so as to prevent movement of the vehicle ramp away from the wheel as the wheel moves up the inclined ramp, the blade being an integral portion of the lower end of the inclined ramp. The ramp also includes brace members for providing rigidity and which are conveniently removably joined at their opposite ends to the leg and the inclined ramp.

1 Claim, 3 Drawing Figures

VEHICLE RAMP

FIELD OF THE INVENTION

The invention relates to vehicle ramps of the type used by amateur auto mechanics or in garages where hydraulic lifts are not available for the repair or maintenance of vehicles.

BACKGROUND PRIOR ART

An example of a prior art vehicle ramp is illustrated in applicant's U.S. Pat. No. 3,873,064, issued Mar. 24, 1975.

A typical prior art vehicle ramp includes a supporting structure or platform for supporting the wheel of a vehicle off of the ground and an inclined structure connected to the supporting structure and adapted to permit the vehicle wheel to be driven up to the supporting structure. In normal use a pair of ramps are employed and the wheels of the vehicle are driven up the inclined structures to the supporting structure. One common problem with some prior art vehicle ramps is that they tend to slide away from the vehicle wheels as the operator attempts to drive up the inclined ramp structure.

SUMMARY OF THE INVENTION

The present invention includes a vehicle ramp for supporting the wheels of a vehicle off of the ground and which includes means for engaging the surface supporting the vehicle ramp as soon as the vehicle wheel begins to move up the ramp or places weight on the ramp and to thereby prevent the ramp from sliding away from the wheel.

The invention provides the further advantage of yielding a structure which can be manufactured inexpensively yet which provides the necessary stability and structural strength. The construction of the vehicle ramp embodying the present invention also includes a brace consruction for joining the inclined portion of the vehicle ramp to the platform structure and which facilitates economical manufacture and assembly. The construction of the vehicle ramp embodying the invention has the added advantage that a pair of such ramps can be packaged in stacked nested relation and in such a manner as to facilitate use of relatively small shipping containers thereby making shipping of the vehicle ramps embodying the invention less expensive and facilitating storage and display of the vehicle ramps in retail establishments.

More particularly, the invention includes a vehicle ramp adapted to rest on a supporting surface and for supporting a vehicle wheel, the vehicle ramp including a platform having a generally horizontal upper surface adapted to support the wheel of a vehicle, a generally vertical leg having an upper end supporting the platform rearward portion and opposite generally vertical side walls, and an inclined ramp adapted to support a vehicle wheel for movement up to the platform. The inclined ramp includes a lower end adapted to engage the ground and an upper end joined to a forward portion of the platform. The lower end of the inclined ramp includes means for engaging the supporting surface as a vehicle wheel engages the lower end of the inclined ramp and applies a downward force on the lower end and so as to prevent movement of the vehicle ramp away from the wheel as the wheel moves up the inclined ramp. The means for engaging the supporting surface includes a blade having a lower edge adapted to engage the supporting surface when weight is placed on the lower end, the lower edge of the blade extending transversely to the longitudinal axis of the inclined ramp, the blade being an integral portion of the lower end of the inclined ramp.

The invention also includes a vehicle ramp adapted to rest on a supporting surface and for supporting a vehicle wheel, the vehicle ramp including a platform having a generally horizontal upper surface adapted to support the wheel of a vehicle, a generally vertical leg having an upper end supporting the platform rearward portion and an inclined ramp having a lower end adapted to engage the ground and an upper end joined to the forward portion of the platform. The lower end of the inclined ramp includes means for engaging the supporting surface as a vehicle wheel engages the lower end of the inclined ramp and applies a downward force on the lower edge and so as to prevent movement of the vehicle ramp away from the wheel as the wheel moves up the inclined ramp. The vehicle ramp further includes means for joining the leg to the inclined ramp, this means including an elongated brace member having one end being shaped to be slideably inserted into a slot in either the leg or the ramp when the elongated brace member is held in a first position and adapted to be locked in the slot against removal when the elongated brace is moved to a second position wherein the opposite end of the brace member is secured in place.

In a preferred embodiment of the invention the blade comprises an integral downturned lip of the lower end of the inclined ramp.

In a preferred form of the invention the brace includes a longitudinal axis and the one end of the brace comprises a planar end member positioned laterally of the longitudal axis.

In a preferred form of the invention the platform and the vertical leg are integrally joined together, and the inclined ramp is integrally joined to the platform. The platform, leg, and inclined ramp are comprised of a single continuous sheet metal plate.

In another embodiment of the invention the platform includes lateral edges extending between its forward and rearward portions and means are provided for rigidifying each of these lateral edges, the means for rigidifying comprising channels each including an inner elongated vertical side wall having a lower edge joined to a lateral edge of the platform, an outer side wall spaced outwardly from the inner side wall, and a bite portion joining the upper edges of the inner elongated vertical side wall and the outer side wall.

In a preferred embodiment of the invention the inclined ramp includes an inclined surface adapted to support a wheel for movement to the platform and lateral edges generally parallel to the longitudinal axis of the inclined ramp, and means are provided for rigidifying these lateral edges, the means for rigidifying comprising channels integrally joined to the channels of the platform so as to form continuous elongated reinforcing means.

Various other features and advantages of the invention will be apparent by reference to the following description of a preferred embodiment, to the claims, and to the drawings.

Figure 1:
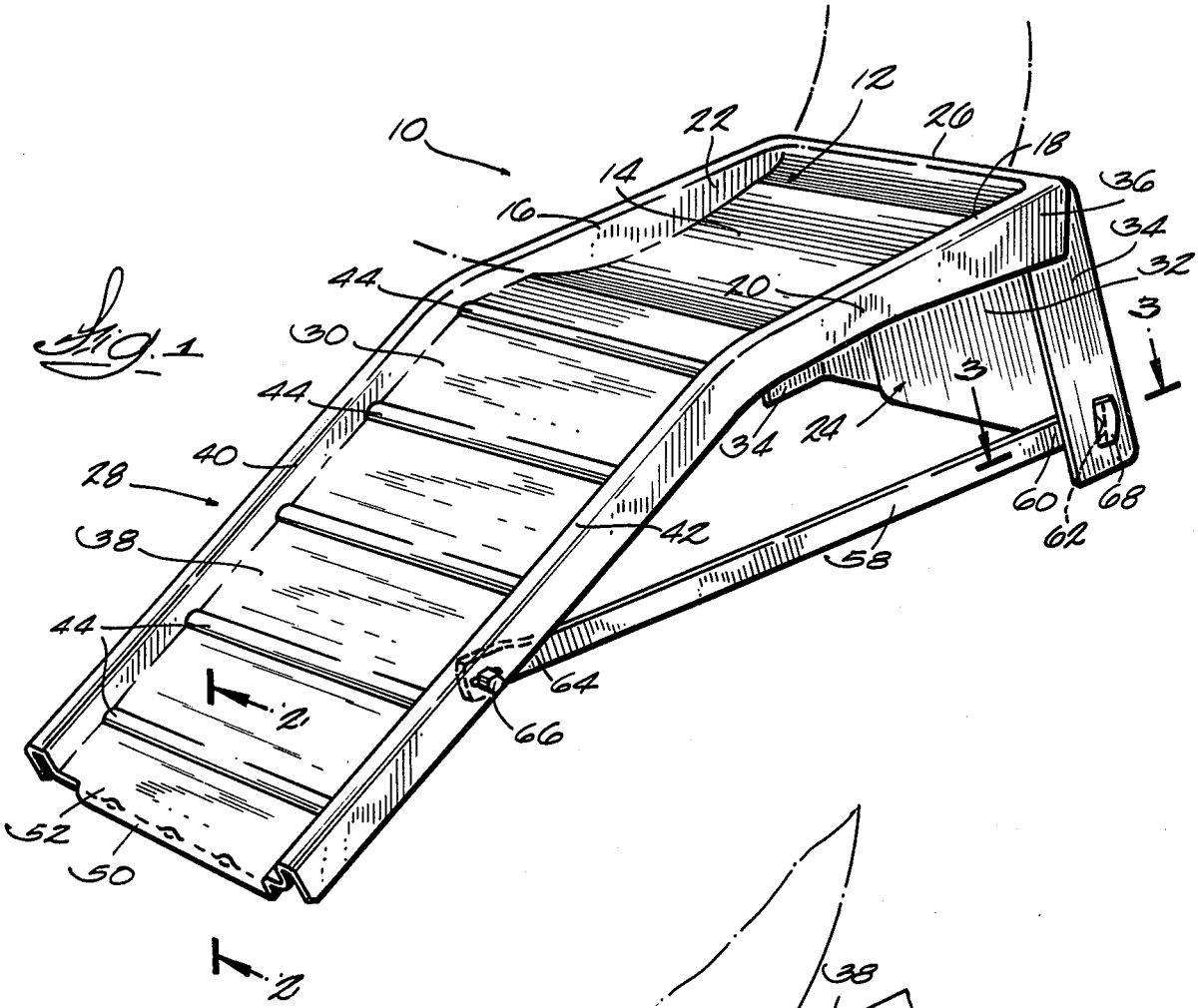
FIG. 1 is an elevation view of a vehicle ramp embodying the present invention.

Before explaining the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a vehicle ramp 10 embodying the present invention and being adapted to support the wheel of a vehicle (not shown) such that the vehicle is elevated and to permit a mechanic to work under the vehicle. The vehicle ramps 10 are commonly employed in pairs, one being placed under each of the vehicle's front wheels or under each of the vehicle's rear wheels. Each vehicle ramp 10 generally includes a platform 12 for supporting a vehicle wheel off of the ground, the platform 12 being illustrated as including an upper generally horizontal surface 14 adapted to support a vehicle wheel. In the particular arrangement illustrated, the lateral edges 16 and 18 of the platform 12 comprise downwardly opening channels thereby providing rigidity to the platform 12, and the channels 16 and 18 are spaced apart sufficiently as to house a portion of a vehicle wheel therebetween. The horizontal surface portion 14 of the platform 12 also includes a concave portion or well portion adapted to receive the vehicle wheel and to prevent movement of the wheel. The channels 16 and 18 forming the parallel lateral edges of the platform 12 each include an outer elongated side wall 20 defining a generally vertical plane, the outer side wall 20 being elongated and extending horizontally along the length of the platform 12. The channels 16 and 18 also each include an inner wall 22 integrally joined to the outer side wall 20 and having a lower edge portion integrally joined to a lateral edge of the generally horizontal surface portion 14 of the platform.

Means are also provided for supporting the platform 12 in elevated relation with respect to a support surface, the means for supporting including a generally vertically oriented leg arrangement 24 having an upper portion supporting the rearward edge 26 of the platform 12. An inclined ramp 28 includes an upper end 30 integrally joined to the forward edge of the platform 12 and functions to support that portion of the platform.

While in other embodiments of the invention, the leg arrangement 24 could be constructed in other ways, in the illustrated arrangement it includes a generally vertical rear wall 32 having an upper edge integrally joined to the rearward edge of the platform 12. The leg arrangement 24 also includes a pair of side walls 34 extending along the vertical edges of the vertical rear walls 32 and forwardly from those edges, the side walls 34 functioning to provide rigidity to the leg arrangement 24. The side walls 34 of the leg arrangement 24 are generally coplanar with the outer side walls 20 of the channels 16 and 18, and the upper portions of the side walls 34 overlap the rearward portions 36 of the side walls 20. These overlapping portions are welded together to rigidly join the side walls 34 of the leg arrangement 24 to the side walls 20 of the platform 12.

Referring now more particularly to the inclined ramp portion 28 or the vehicle ramp, it includes an inclined surface 38 integrally joined at its upper end to the forward edge of the platform 12, the lateral edges of the inclined surface 38 being reinforced by channels 40 and 42 integral therewith and continuously joined at their upper ends to the channels 16 and 18, respectively, of the lateral sides of the platform 12. The inclined surface 38 also includes a plurality of transverse ribs 44 extending perpendicularly to the longitudinal axis of the inclined ramp 28, the transverse ribs 44 being parallel and spaced along the length of the inclined ramp. The transverse ribs 44 provide for traction on the ramp surface and also add to the strength of the ramp.

Figure 2:
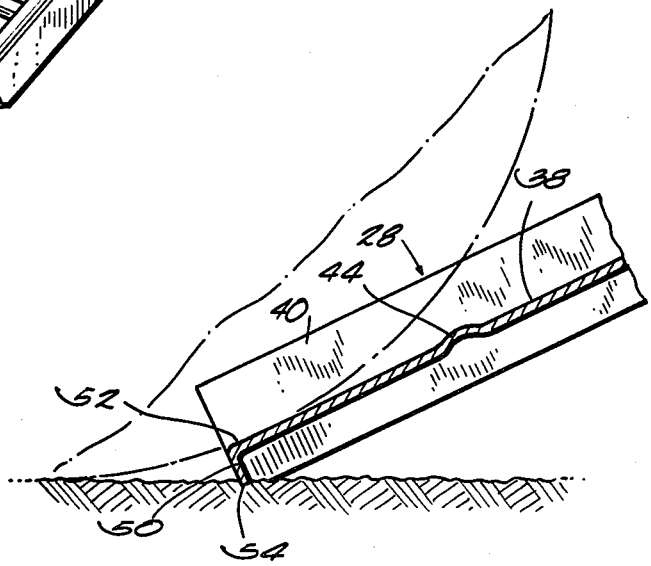
FIG. 2 is an enlarged view of a portion of the vehicle ramp illustrated in FIG. 1.

Means are also provided for engaging the supporting surface and for preventing sliding movement of the vehicle ramp 10 away from the vehicle wheel when a wheel begins to move up the inclined surface 38 of the vehicle ramp. The means for engaging the supporting surface includes a blade 50 joined to the lower edge 52 of the inclined surface 38 and including a lower edge 54 (FIG. 2) adapted to dig into the supporting surface when weight is placed on the forward or lower edge 52 of the inclined ramp 28 such as when the wheel of the vehicle begins to move up the ramp. While the blade 50 could be formed in various ways, in the preferred form of the invention illustrated in FIG. 2, the blade 50 is an integral portion of the lower edge 52 of the inclined ramp 28 and comprises a downwardly bent lower edge or lip of the lower edge 52 of the ramp. In the illustrated construction, the blade 50 extends across substantially the entire width of the lower edge 52 of the ramp and defines a plane perpendicular to the inclined surface 38 of the ramp. Since the blade 50 is an integral portion of the ramp 28, the lower edge 54 of the blade 50 has a thickness equal to that of the sheet metal used in forming the vehicle ramp and is, accordingly, relatively sharp and adapted to dig into the supporting surface when a vehicle wheel places weight on the lower end 52 and begins to move up the ramp.

The construction of the lower end of the leg portion 24 is also constructed so as to have a relatively sharp lower edge and to thereby prevent sliding movement of the vehicle ramp 10 once the wheel of the vehicle begins to move up the ramp and places weight on the inclined ramp 28 and the platform 12.

While the construction described above could be manufactured or formed in various ways, in one form of the invention, the platform portion 12, the leg arrangement 24, and the inclined ramp portion 28 are formed in a press by stamping a single metal sheet to form the structure defined above.

Means are further provided for connecting a lower portion of the leg arrangement 24 to the inclined ramp portion 28 to thereby provide means for increasing the strength of the vehicle ramp. Such connecting means are provided by a pair of brace members 58 (one shown) positioned on opposite sides of the vehicle ramp. In a preferred form of the invention, each of the brace members 58 comprises an elongated member having one end 60 which is shaped so as to be slidably insertable into a slot 62 (FIG. 3) formed in the side wall 34 of the leg arrangement 24 and adjacent the lower end of the leg. The opposite end 64 of the brace member 58 is fixed to a side portion 40 or 42 of the inclined ramp 28 by a bolt 66 extending through the brace member and through the side portion 40 or 42 of the ramp. Referring more particularly to the construction of the brace 58, in the illustrated arrangement the brace is formed by stamping an elongated length of sheet metal to thereby form an elongated channel member comprising a web portion and opposite side walls. That end 60 of the brace 58 adapted to be slidably housed in the slot 62 includes a generally flat portion 68 offset from the longitudinal axis of the brace 58, the flat portion 68 being joined to the web by a transverse portion 70. The opposite end of the brace member includes a bore adapted to house the bolt 66.

Figure 3:
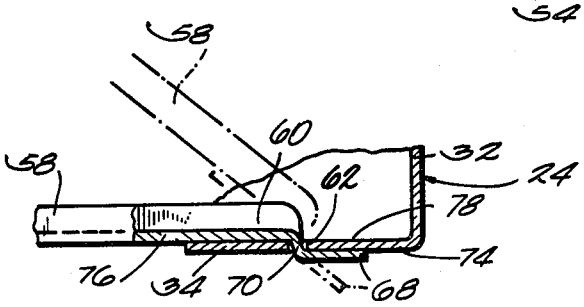
FIG. 3 is an enlarged view of the brace and leg connection illustrated in FIG. 1.

The brace member 58 is secured to the vehicle ramp 10 by inserting the flat end portion 68 of the brace into the slot 62 with the brace member 58 being held at an acute angle, as shown in phantom in FIG. 3, with respect to the vertical plane defined by the side of the vehicle ramp. It should be noted that the slot 62 in the side wall 34 of the leg is perpendicular to the longitudinal axis of the brace member when the brace member is fixed in place. Once the end portion 60 of the brace member 58 is inserted into the slot 62, the brace member 58 is pivoted toward the plane of the side wall 34 and the other end 64 of the brace member 58 is fixed by the bolt 66 to the side 40 or 42 of the inclined ramp 28. When the brace 58 is so positioned, the flat end portion 68 of the brace is adjacent one surface 74 of the side wall 34 of the leg 24 and the web portion 76 of the brace 58 engages the opposite surface 78 of the leg side wall 34. The transverse portion 70 of the brace end is housed in the slot 62 and functions to restrain the side wall 34 of the leg 24 for movement toward or away from the inclined ramp 28 thereby rigidifying the ramp 10.

One of the advantages of the construction described is that the brace member 58 can be easily attached and employs only one bolt 66, yet it effectively rigidifies the vehicle ramp 10. The construction of the brace member 58 and the means for attaching the brace member 58 facilitates both inexpensive manufacture of the vehicle ramp 10 and easy assembly by the purchaser. Another advantage of the construction of the vehicle ramp 10 described above and arising from the convenience of attaching the brace member, is that, with the brace members 58 removed, a pair of vehicle ramps 10 can be conveniently packaged in stacked, nested relation. This facilitates packing of the vehicle ramps in smaller containers and thereby facilitates shipping since a greater number of vehicle ramps can be included in each truck load. The smaller package also facilitates display and storage in retail establishments.

Various features of the invention are set forth in the following claims.

I claim:

1. A vehicle ramp adapted to rest on a supporting surface and for supporting a vehicle wheel, the vehicle ramp comprising a platform having a generally horizontal upper surface adapted to support the wheel of a vehicle, said platform having a forward portion and a rearward portion, and said platform including lateral edges extending between said forward portion and said rearward portion, and means for rigidifying each of said lateral edges, said means for rigidifying comprising a channel including an inner elongated vertical side wall having a lower edge joined to said lateral edge of said platform, an outer side wall spaced outwardly from said inner side wall, and a bite portion joining the upper edges of said inner elongated vertical side wall and said outer side wall, a single generally vertical leg having an upper end supporting said platform rearward portion, and said vertical leg including opposite generally vertical side walls, said side walls of said leg each including a slot therein, an inclined ramp adapted to support a vehicle wheel for movement up to said platform, said inclined ramp including a longitudinal axis and having opposite sides, a lower end adapted to engage the ground, and an upper end joined to said forward portion of said platform, said lower end of said inclined ramp including means for engaging the supporting surface as a vehicle wheel engages said lower end of the inclined ramp and applies a downward force on the said lower end and so as to prevent movement of the vehicle ramp away from the wheel as the wheel moves up the inclined ramp, said means for engaging the supporting surface including a blade having a lower edge adapted to engage said supporting surface when weight is placed on said lower end, said blade lower edge extending transversely to the longitudinal axis of said inclined ramp, and said blade being an integral portion of said lower end of said inclined ramp, said inclined ramp including an inclined surface adapted to support a wheel for movement to said platform and lateral edges generally parallel to the longitudinal axis of said inclined ramp, means for rigidifying each of said lateral edges, said means for rigidifying comprising channels integrally joined to said channels of said platform so as to form continuous elongated reinforcing means, said platform, said leg, and said inclined ramp having a one piece unitary construction and being integrally joined together and formed from a single continuous stamped sheet metal plate, and means for joining said leg intermediate the opposite ends of said leg to said inclined ramp intermediate said upper end and said lower end of said inclined ramp, said means for joining including an elongated brace member having opposite ends, one of said ends having generally flat portion offset from the longitudinal axis of the brace member in order to be slidably inserted into said slot in one of said side walls of said leg when said elongated brace member is held in a first position and also being adapted to be locked in said slot against removal when said elongated brace is moved from said first position to a second position wherein the opposite end of said brace member engages a side of said ramp, and means for securing said opposite end of brace member to the said side of said ramp.

* * * * *